US010417846B1

(12) United States Patent
Smith

(10) Patent No.: US 10,417,846 B1
(45) Date of Patent: Sep. 17, 2019

(54) CONTROLLED ENVIRONMENT FACILITY VISITATION SYSTEM USING PERSONAL DEVICES

(71) Applicant: Securus Technologies, Inc., Carrollton, TX (US)

(72) Inventor: Matthew R. Smith, McKinney, TX (US)

(73) Assignee: Securus Technologies, Inc., Carrollton, TX (US)

( * ) Notice: Subject to any disclaimer, the term of this patent is extended or adjusted under 35 U.S.C. 154(b) by 0 days.

(21) Appl. No.: 15/807,072

(22) Filed: Nov. 8, 2017

(51) Int. Cl.
*G07C 9/00* (2006.01)

(52) U.S. Cl.
CPC ..... *G07C 9/00031* (2013.01); *G07C 9/00309* (2013.01); *G07C 9/00896* (2013.01); *G07C 2009/00769* (2013.01)

(58) Field of Classification Search
CPC ..... G07C 9/00031; G07C 9/00309; G07C 9/00896; G07C 2009/00769; H04M 3/2281; H04M 3/4365; H04M 3/42059; H04M 15/844; H04M 15/80; H04M 2201/405; H04M 2250/52; H04M 2250/22; H04W 12/06; H04L 63/0861; H04L 63/083
See application file for complete search history.

(56) References Cited

U.S. PATENT DOCUMENTS

| | | | | |
|---|---|---|---|---|
| 9,007,420 | B1 * | 4/2015 | Passe | H04M 3/42059 348/14.01 |
| 9,055,167 | B1 * | 6/2015 | Keiser | H04M 15/08 |
| 9,084,013 | B1 * | 7/2015 | Arini | H04N 21/44204 |
| 9,094,500 | B1 * | 7/2015 | Edwards | H04M 3/2281 |
| 9,106,789 | B1 * | 8/2015 | Shipman, Jr. | H04N 7/147 |
| 9,380,082 | B1 * | 6/2016 | Keiser | H04N 7/181 |
| 9,420,094 | B1 * | 8/2016 | Keiser | H04M 3/4365 |
| 9,667,763 | B1 * | 5/2017 | Keiser | H04M 1/667 |
| 10,147,249 | B1 * | 12/2018 | Brady | G07C 9/00103 |
| 2007/0103548 | A1 * | 5/2007 | Carter | H04M 11/025 348/143 |
| 2007/0168674 | A1 * | 7/2007 | Nonaka | G06Q 20/341 713/182 |
| 2011/0289064 | A1 * | 11/2011 | Lebeau | G06F 17/3087 707/706 |

(Continued)

*Primary Examiner* — Brian E Miller
(74) *Attorney, Agent, or Firm* — Fogarty LLP

(57) ABSTRACT

A visitation system provides visitation sessions between a resident of a controlled-environment facility and a nonresident, where the nonresident utilizes a personal wireless devices that connects to a wireless access point that may be accessible from a designated visitation area of the facility. A connection request from a personal wireless device of a nonresident is evaluated to determine the personal wireless device is authorized to interface with the visitation system, and whether the nonresident is authorized to communicate with the resident. If authorized, a visitation session between the resident and the nonresident is initiated with the nonresident participating via the personal wireless device. The visitation system may respond to a visitation session request from a registered personal wireless device by sending an access code to the personal wireless device. By confirming the access code, the nonresident may initiate the requested visitation session that terminates upon expiration of the access code.

20 Claims, 5 Drawing Sheets

(56) References Cited

U.S. PATENT DOCUMENTS

2012/0249290 A1* 10/2012 Marsh ..... H04M 11/025 340/5.7
2014/0210590 A1* 7/2014 Castro ..... G07C 9/00563 340/5.52
2015/0109104 A1* 4/2015 Fadell ..... G08B 27/003 340/5.65
2015/0109112 A1* 4/2015 Fadell ..... G08B 27/003 340/328
2015/0112885 A1* 4/2015 Fadell ..... G08B 27/00 705/330
2015/0116107 A1* 4/2015 Fadell ..... G08B 19/005 340/501
2015/0116109 A1* 4/2015 Fadell ..... G08B 19/005 340/501
2015/0120598 A1* 4/2015 Fadell ..... G06Q 10/083 705/333
2015/0221147 A1* 8/2015 Daniel-Wayman ..... G07C 9/00103 340/5.54
2015/0379796 A1* 12/2015 Glasgow ..... G09C 1/00 340/5.51
2016/0261931 A1* 9/2016 Fadell ..... H04Q 9/00
2016/0284139 A1* 9/2016 Klein ..... G07C 9/00007
2016/0284140 A1* 9/2016 Klein ..... G07C 9/00007
2017/0099387 A1* 4/2017 Keiser ..... H04M 3/4365
2017/0171717 A1* 6/2017 Shulman ..... G08B 21/22
2017/0251100 A1* 8/2017 Keiser ..... H04L 63/10
2017/0270732 A1* 9/2017 Troesch ..... G07C 9/00896
2017/0280109 A1* 9/2017 Scalisi ..... H04N 5/2257
2017/0345285 A1* 11/2017 Merjanian ..... G08B 27/005
2018/0144568 A1* 5/2018 Lingan ..... H04W 4/029
2018/0146095 A1* 5/2018 Winston ..... H04M 3/537

* cited by examiner

CONTROLLED ENVIRONMENT FACILITY VISITATION SYSTEM USING PERSONAL DEVICES

TECHNICAL FIELD

The following description relates generally to visitation services provided to residents of a controlled environment facility, and more particularly to providing visitation services using authorized personal devices.

BACKGROUND OF THE INVENTION

It is estimated that over two million individuals are incarcerated in U.S. prisons and jails. In general, inmates that have been convicted of felony offenses serve longer sentences in prisons (e.g., federal or state prisons), whereas inmates that have been convicted of misdemeanors receive shorter sentences that are frequently served in local jails (e.g., county jail). In addition, upon being detained by authorities, an inmate may serve significant periods of time incarcerated in a local jail while awaiting release on bond and, in some cases, while awaiting trial. During all of these periods of incarceration, an inmate may have opportunities to communicate with the outside world.

By allowing inmates to communicate with friends and family while incarcerated, the justice system aims to facilitate the inmate's transition back into society upon being released. Traditional visitation sessions provided by controlled-environment facilities include telephone calls and supervised, in-person visits. Providing in-person visits requires the controlled-environment facility to implement procedures by which both the visitor and the inmate are closely screened and monitored in order to prevent the transfer of contraband during the in-person visit. Another type of offered visitation session involves an inmate and a visitor communicating audio via visitation terminals while physically separated by a glass or otherwise transparent barrier that allows the parties to see each other during the visitation. Another type of visitation session that may be supported involves an inmate and a visitor participating in a video visitation session, each using visitation terminals that include audio and video capabilities. Although such video visitations do not technically require the visitor to be present at the controlled-environment facility, various rules and restrictions may require that a visitation session be conducted in a monitored visitation area.

In certain scenarios, the number and type of visitations sessions that are supported by a controlled-environment facility may be limited by the visitation terminals that are available for use by visitors. Certain controlled-environment facilities may face resource limitations that limit the number of visitation terminals that can be supported, thus limiting the number of visitation sessions that may be conducted.

BRIEF SUMMARY

A visitation system according to various embodiments provides visitation services to a resident of a controlled-environment facility. The visitation system includes: an external wireless access point configured to receive a connection request from a personal wireless device of a nonresident, wherein the external wireless access point is accessible from a designated visitation area of the controlled-environment facility; an authorization server configured to evaluate the connection request, wherein the evaluation determines whether the personal wireless device of the nonresident is authorized to interface with the visitation system, and wherein the evaluation determines whether the nonresident is authorized to communicate with the resident; and a visitation server configured to establish a visitation session between the resident and the nonresident, wherein the nonresident participates via the personal wireless device.

In certain additional embodiments of the visitation system, the nonresident participates in the visitation session via a visitation system software program installed on the personal wireless device. In certain additional embodiments of the visitation system, the visitation system software program is operable by the nonresident only while the personal wireless device is connected to the external wireless access point. In certain additional embodiments of the visitation system, the connection request comprises a request for the visitation session between the nonresident and the resident. In certain additional embodiments of the visitation system, the identity of the nonresident is confirmed in order for the nonresident to be admitted to the designated visitation area. In certain additional embodiments of the visitation system, the confirmed identity of the nonresident is provided to the visitation system. In certain additional embodiments of the visitation system, the visitation server is configured to identify a scheduled visitation session based on the admittance of the nonresident to the designated visitation area. In certain additional embodiments of the visitation system, determining whether the personal wireless device of the nonresident is authorized to interface with the visitation system authentication server comprises determining whether a unique identifier associated with the personal wireless device indicates the personal wireless device has been previously registered by the visitation system. In certain additional embodiments of the visitation system, the authentication server sends an access code to a phone number previously registered as being associated with the personal wireless device. In certain additional embodiments of the visitation system, the authentication server authorizes the visitation session upon receiving the access code from the nonresident via a user interface on the personal wireless device. In certain additional embodiments of the visitation system, the visitation session is terminated upon expiration of the access code.

A visitation system according to various embodiments provides visitation services to a resident of a controlled-environment facility. The method includes: receiving, at an external wireless access point, a connection request from a personal wireless device of a nonresident, wherein the external wireless access point is accessible from a designated visitation area of the controlled-environment facility; evaluating, by an authorization server, the connection request, wherein the evaluation determines whether the personal wireless device of the nonresident is authorized to access the visitation services, and wherein the evaluation determines whether the nonresident is authorized to communicate with the resident; and establishing, by a visitation server, a visitation session between the resident and the nonresident, wherein the nonresident participates via the personal wireless device.

In certain additional embodiments of the method, the connection request comprises a request for the visitation session between the nonresident and the resident. In certain additional embodiments of the method, the identity of the nonresident is confirmed in order for the nonresident to be admitted to the designated visitation area. In certain additional embodiments of the method, the confirmed identity of the nonresident is provided to the visitation system. In certain additional embodiments, the method further includes identifying, by the visitation server, a scheduled visitation session based on the admittance of the nonresident to the designated visitation area. In certain additional embodiments of the method, determining whether the personal wireless device of the nonresident is authorized to access the visitation services comprises determining whether a unique identifier associated with the personal wireless device indicates the personal wireless device has been previously registered. In certain additional embodiments, the method further includes sending a text message including an access code to a phone number previously registered as being associated with the personal wireless device. In certain additional embodiments, the method further includes authorizing, by the authentication server, the visitation session upon receiving the access code from the nonresident via a user interface on the personal wireless device. In certain additional embodiments, the method further includes terminating the visitation session upon expiration of the access code.

A computer-readable storage device according to various embodiments provides a storage device having program instructions stored thereon for providing visitation services to a resident of a controlled-environment facility, upon execution by a one or more processors, the program instructions cause the one or more processors to: receive a connection request from a personal wireless device of a nonresident, wherein the external wireless access point is accessible from a designated visitation area of the controlled-environment facility; evaluate the connection request, wherein the evaluation determines whether the personal wireless device of the nonresident is authorized to access the visitation services, and wherein the evaluation determines whether the nonresident is authorized to communicate with the resident; and establish a visitation session between the resident and the nonresident, wherein the nonresident participates via the personal wireless device. In certain additional embodiments of the computer-readable storage device, the connection request comprises a request for the visitation session between the nonresident and the resident.

BRIEF DESCRIPTION OF THE DRAWINGS

Figure 1:
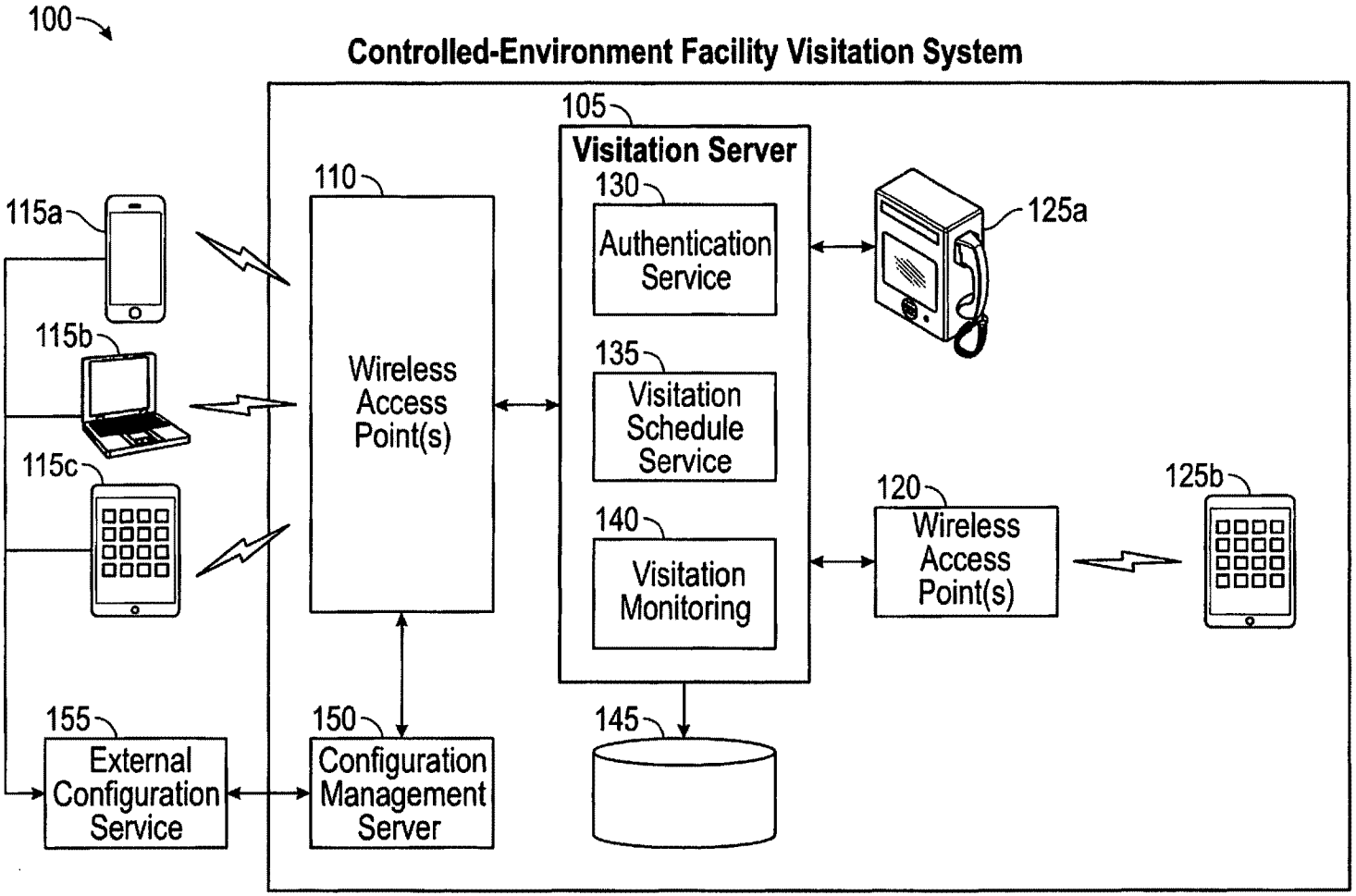

Having thus described the invention in general terms, reference will now be made to the accompanying drawings, which are not necessarily drawn to scale, and wherein:

FIG. 1 is a diagram illustrating certain components of a visitation system according to various embodiments for providing residents of a controlled environment facility with visitation services, in which a nonresident participates using a personal wireless device.

Figure 2:
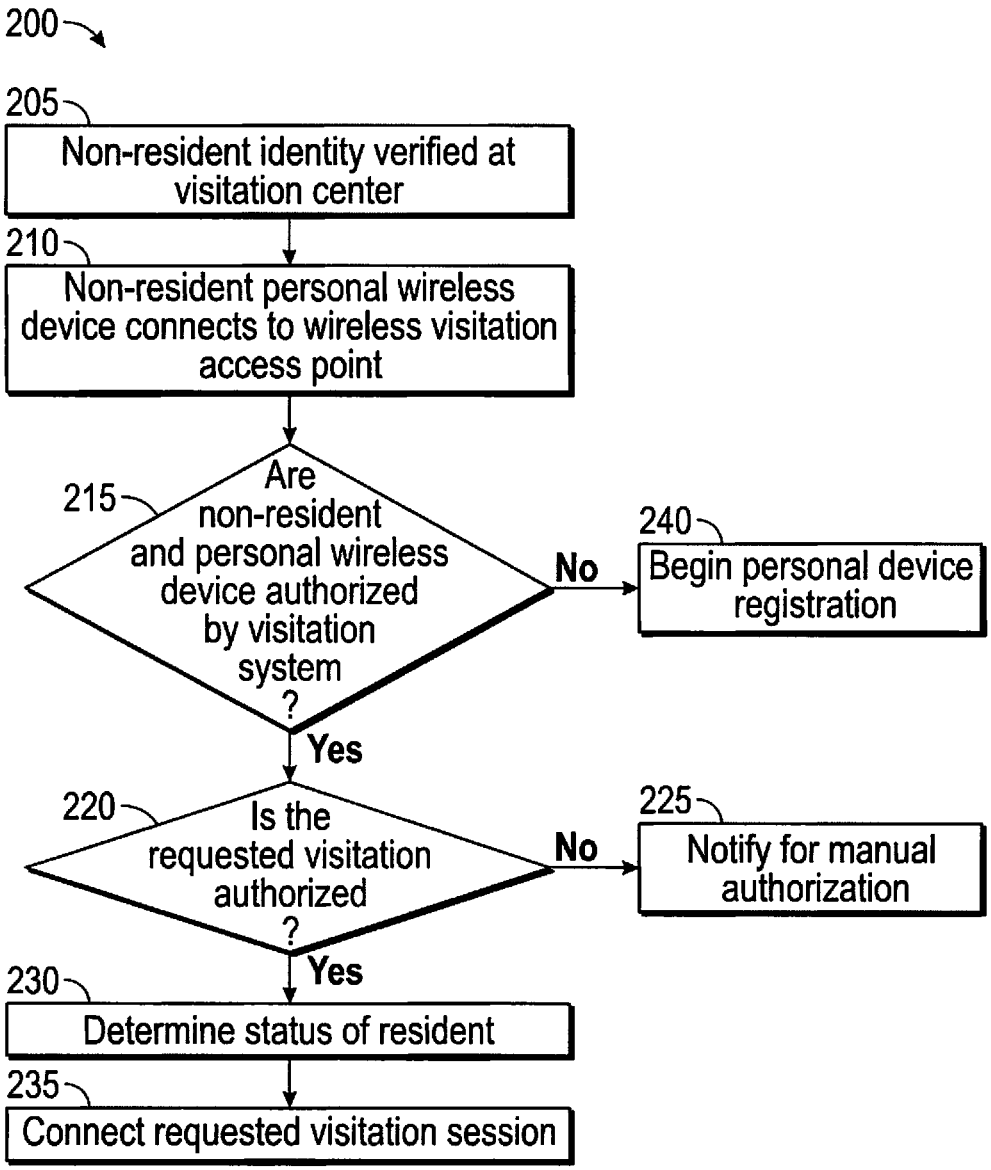

FIG. 2 is a flowchart diagram illustrating certain steps of a process according to various embodiments for providing visitation services to residents of a controlled environment facility, in which the nonresident participates using a personal wireless device.

Figure 3:
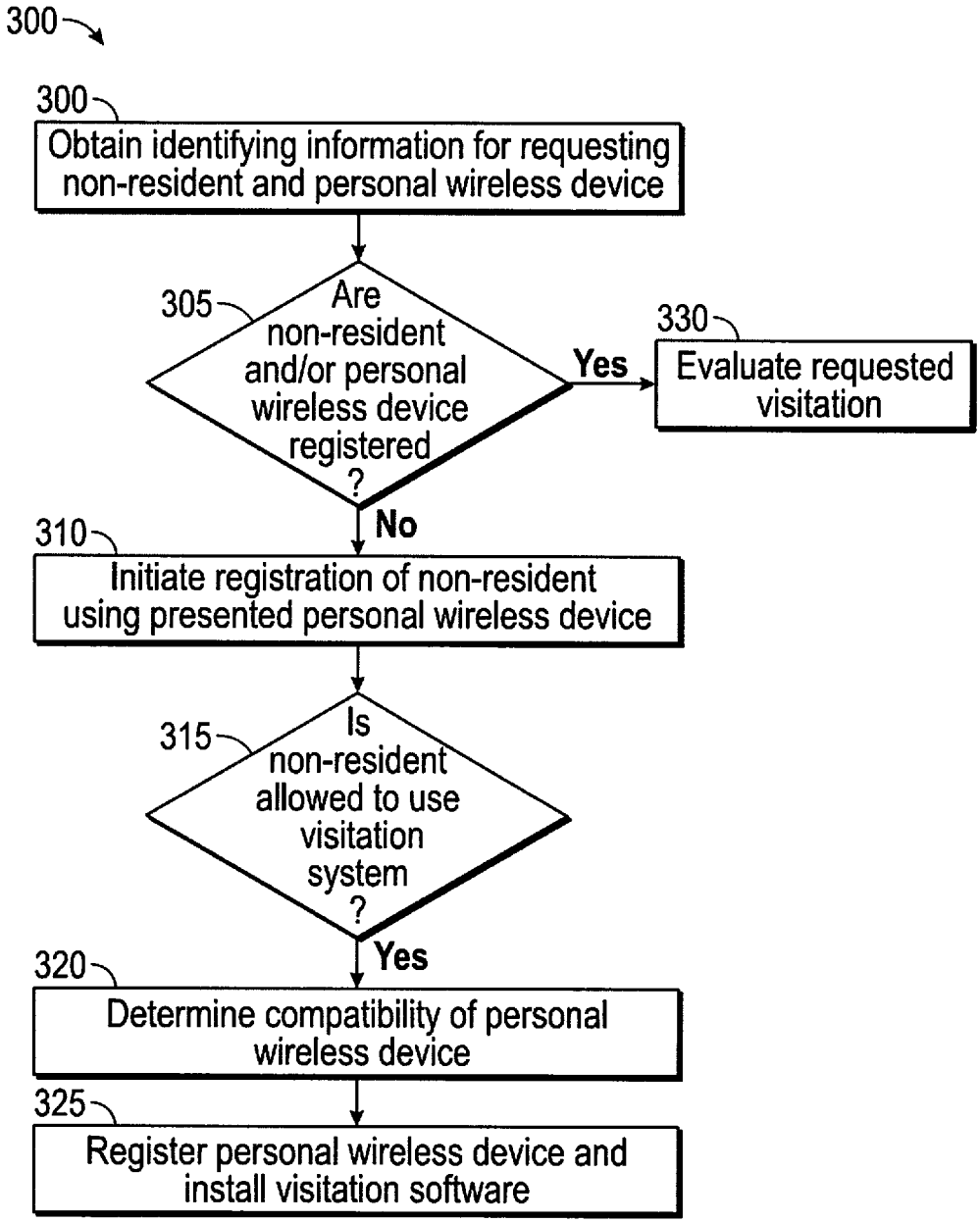

FIG. 3 is a flowchart diagram illustrating certain steps of a process according to various embodiments for registering a personal wireless device of the nonresident for participating in visitation services.

Figure 4:
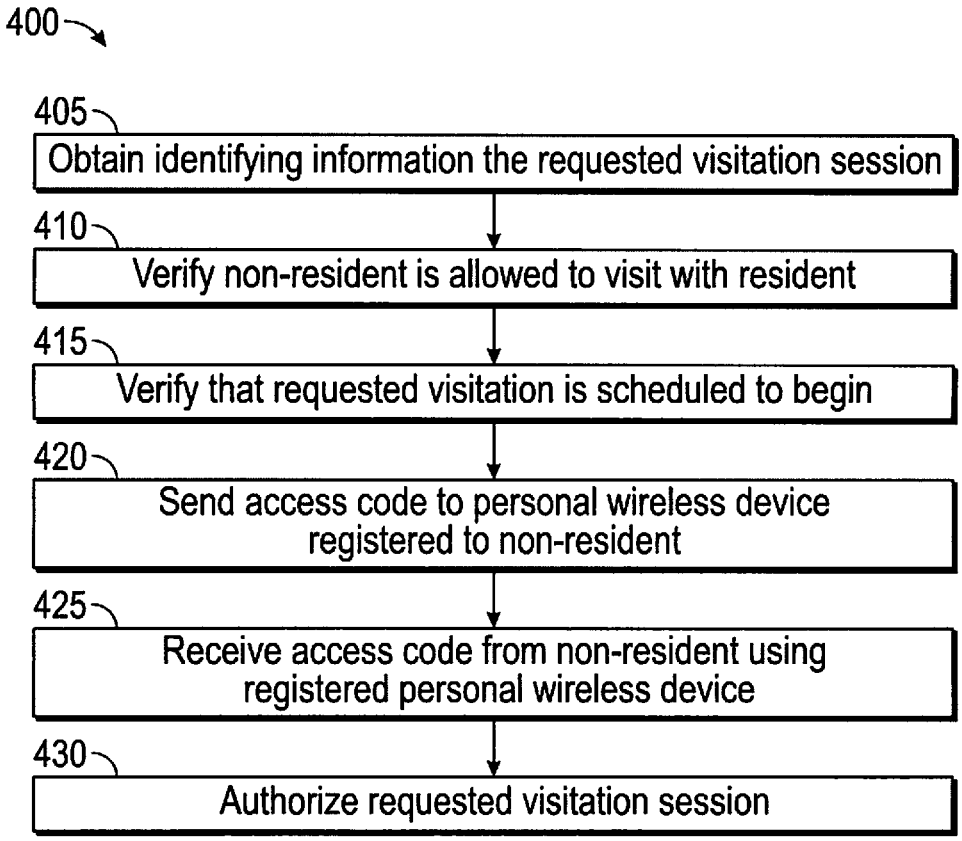

FIG. 4 is a flowchart diagram illustrating certain steps of a process according to various embodiments for authorizing a visitation session between a resident and a nonresident using a personal wireless device.

Figure 5:
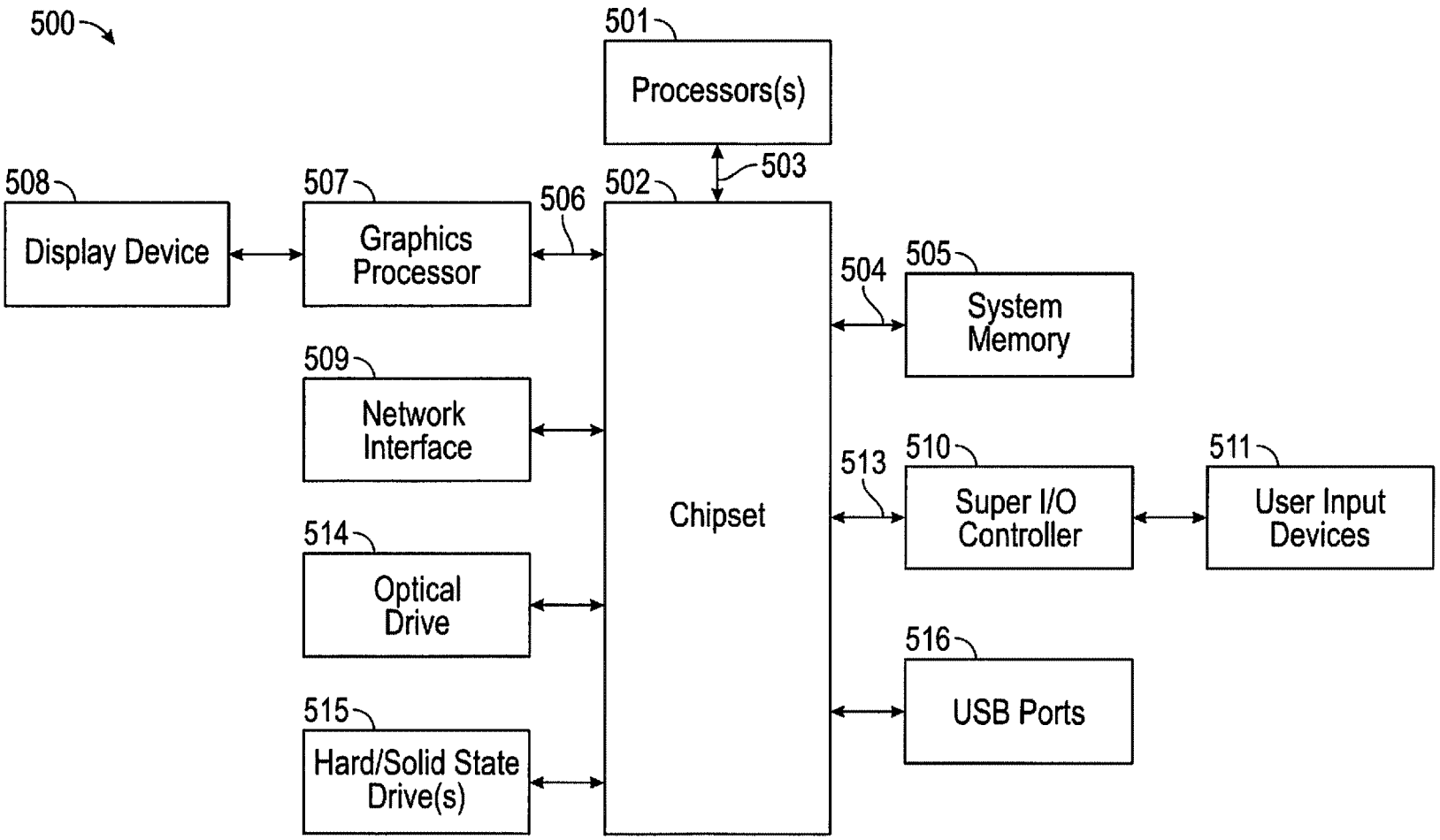

FIG. 5 is a block diagram illustrating certain components of a visitation system according to various embodiments.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention For example, various types of controlled-environment facilities are present in today's society, and persons may be voluntary or involuntary residents of such facilities, whether temporarily or permanently. Examples of controlled-environment facilities may include correctional institutions (e.g., municipal jails, county jails, state prisons, federal prisons, military stockades, juvenile facilities, detention camps, home incarceration environments, etc.), certain healthcare facilities (e.g., certain hospitals and nursing homes, certain mental health facilities, certain rehabilitation facilities, such as drug and alcohol rehabilitation facilities, etc.), certain restricted living quarters (e.g., barracks, certain dormitories, etc.), certain educational facilities (e.g., primary, secondary and post-secondary schools) and the like. For convenience of explanation, various examples discussed herein are presented in the context of correctional facilities, or the like. For instance, in some of the embodiments discussed below, a controlled-environment facility may be referred to as a correctional facility, jail or prison, and its residents may be referred to as inmates, arrestees, or detainees. It should be understood, however, that the systems and methods described herein may be similarly applicable to other types of controlled environment facilities and their respective residents (e.g., a hospital and its patients, a school dormitory and its students, etc.).

FIG. 1 is a diagram illustrating certain components of a controlled environment facility visitation system 100 according to various embodiments. As illustrated, the controlled environment facility visitation system 100 includes a visitation server 105 that is configured to provide visitation sessions between a resident of a controlled-environment facility and a nonresident. As described with respect to FIG. 5, in various embodiments, a visitation server 105 may assume a variety of forms. In certain embodiments the visitation server 105 may be a component of a larger communications system that is utilized by the controlled environment facility. In certain scenarios, such a communications system may provide residents with access to various visitation services. For instance, a communications system may provide inmates with visitation services such as voice visitation services, video visitation services, email, online chats and/or messaging services.

In some embodiments, a controlled environment facility visitation system 100 may be located within and serve a single controlled-environment facility. Alternatively, a controlled environment facility visitation system 100 may be centrally and/or remotely located with respect to one or more controlled-environment facilities. Whether serving a single controlled-environment facility or located remotely and serving multiple facilities, a controlled environment facility visitation system 100 may be used to provide visitation sessions to residents of controlled-environment facilities, in which a nonresident may participate in the visitation sessions from a monitored visitation area using a wireless personal device.

In the supported visitation sessions, nonresidents may participate using a variety of personal wireless devices 115*a-c*. In certain scenarios, visitation sessions may be supported for any type of personal wireless device capable of connecting to a conventional Wireless Local Area Network (WLAN) access point. In the illustrated embodiment, the nonresident may participate in the provided visitation services using a supported smart phone device 115*a* that is capable of supporting WLAN connectivity and, in some scenarios, is also capable of supporting third-party applications (i.e. smart phone and/or mobile device apps). As illustrated, a nonresident may also participate in the visitation services using a laptop device 115*b* that includes WLAN connectivity, utilizes a supported operating system and is capable of supporting required third-party applications. In the illustrated embodiment, the nonresident may also participate using a supported tablet device 115*c* that includes WLAN connectivity and is capable of supporting third-party software applications (i.e. smart phone and mobile device apps).

In certain embodiments, the nonresident's participation in the provided visitation services using a personal wireless device may be restricted to a specific visitation area provided by the controlled-environment facility. For instance, a nonresident may be received at the visitation area by a staff member of the controlled environment facility that verifies the identity of the nonresident. In other scenarios, the identity of the nonresident may be verified in whole or in part using biometrics. Upon being admitted to the controlled visitation area, the nonresident may utilize their personal wireless device to connect to the visitation network hosted by external wireless access point 110 and, if so authorized, to participate in a requested visitation session with a resident of the controlled environment facility. By requiring the visitation session to be conducted with the nonresident at the visitation area, the controlled environment facility may provide visitation services while still monitoring all aspects of the resident's and the nonresident's participation in the visitation session. As described, an approved visitation session may be conducted using the personal wireless device of the nonresident. However, because the nonresident accesses the external wireless access point 110 from within a controlled visitation area of the controlled environment facility, all communication networks and systems used to provide the visitation session are under the control of the controlled environment facility, thus allowing all aspects of the visitation session to be recorded and monitored. In addition, since the visitation session is provided without the possibility of physical contact between the resident and the nonresident, less stringent security procedures may be utilized with regard to physically screening the resident and the nonresident prior to visitation session.

In certain embodiments, the nonresident initiates the visitation session by attempting to connect to external wireless access point 110 using the personal wireless device 115*a-c*. In certain embodiments, the external wireless access point 110 may broadcast an SSID (service set identifier) associated with the controlled environment facility visitation system 100. In certain embodiments, the external wireless access point 110 may implement an initial screening of incoming connection requests received from the personal wireless devices 115*a-c* utilized by the nonresidents. For instance, in certain embodiments, the external wireless access point 110 may determine whether an incoming connection request originates from a registered personal wireless device, in which case the connection request from a recognized nonresident may be directed to the visitation server 105 for evaluation of the visitation request. In certain embodiments, the external wireless access point 110 may rely on the authentication service 130 or other component of the visitation server 105 to determine whether a connection request originates from a registered personal wireless device.

In certain of such embodiments, the external wireless access point 110 may direct incoming connection requests from unrecognized personal wireless devices to a configuration management server 150. In the illustrated embodiment, the personal wireless devices 115*a-c* may be configured for use of the provided visitation system by a configuration management server 150 that is a component of the controlled environment facility visitation system 100. The embodiment illustrated in FIG. 1 also includes an external configuration service 155 that may be utilized to deliver and manage the installation of software necessary to utilize the provided visitation services on the non-resident personal wireless devices 115*a-c*. In certain embodiments, the configuration of the personal wireless devices 115*a-c* may be provided by various different combinations of internal and external configuration components.

In scenarios where an incoming connection request is received from a personal wireless device 115*a* that is recognized by the external wireless access point 110, the connection request may be forwarded to the visitation server 105. In the illustrated embodiment, the visitation server 105 includes an authentication service 130 that processes incoming connection requests from nonresident personal wireless devices 115*a-c*. In certain embodiments, the authentication service 130 may be configured to interface with a software application previously installed on the personal wireless device 115*a-c* during its configuration for participating in the provided visitation service.

In certain embodiments, the authentication service 130 may process an incoming connection request from a personal wireless device 115*a-c* by interrogating the personal wireless device 115*a-c* and/or the nonresident in order to obtain additional identifying information which may be used to authenticate the personal wireless device and/or the nonresident. As described in additional detail in the following embodiments, the authentication service 130 may operate by restricting visitations to personal wireless devices that have been verified as associated with an individual allowed to utilize the provided visitation services. Also as described, the authentication service 130 may authorize individual visitation requests utilizing session access codes that require confirmation by the nonresident and expire at the specified ending time for the visitation session.

As illustrated in FIG. 1, the visitation server 105 may additionally include a visitation schedule service 135. In certain embodiments, the authentication service 130 may interface with the visitation schedule service 135 in order to determine if a requested visitation session has been properly scheduled and authorized. In certain embodiments, the visitation server 105 may additionally utilize the visitation schedule service 135 in allowing nonresidents using personal wireless devices 115*a-c* that have been properly authenticated to access available capabilities for requesting and scheduling additional visitation sessions, subject to the restrictions and limitations that may be enforced on visitation sessions, such as limits on number and duration of visitation session allowed for a particular resident, specific dates and times during which visitation sessions allowed by the controlled environment facility, and the availability of visitation terminals that are required for residents to participate.

Once an incoming visitation session request from a personal wireless device 115*a-c* has been properly authenticated and determined to correspond to a properly scheduled visitation request, the visitation server 105 may proceed to establishing a visitation session linking the personal wireless device 115*a-c* of the nonresident and a visitation device 125*a-b* being used by the resident. As illustrated in FIG. 1, the visitation session proceeds with the nonresident utilizing a personal wireless device 115*a-c* while connected directly to a network operated and controlled by the controlled-environment facility, in this scenario the wireless network provided via the external wireless access point 110. As such, all of the communications that comprise the visitation session between the nonresident and the resident are transmitted via communication links controlled and operated by the controlled-environment facility. Accordingly, visitation server 105 may interface with the visitation monitoring procedures 140 that are utilized by the controlled environment facility in order to record visitations and to detect illicit or otherwise unauthorized activities during the visitation session.

Various additional restrictions on the requested visitation session may be enforced via the communication devices 125*a-c* utilized by the residents. In certain embodiments, the controlled environment facility visitation system 100 may provide residents of the controlled-environment facility with communication services using a resident communications terminal 125*a*. In certain scenarios, the resident communications terminal 125*a* may be mounted on a wall, within a booth, or as part of kiosk. In certain scenarios, the resident communications terminal 125*a* may be a hardened terminal and may be installed in an area of the controlled-environment facility dedicated to providing residents with visitation sessions. In certain embodiments, resident communications terminal 125*a* may provide a resident with the ability to participate in video visitation sessions. Such a resident communications terminal 125*a* may be referred to as an Intelligent Facility Device (IFD), which may be a video phone particularly adapted for use in a controlled-environment facility. A resident communications terminal 125*a* may be adapted to provide residents with various additional services in addition to visitation sessions.

In various embodiments, a resident communications terminal 125*a* may include a video display, a camera, and a handset that includes a microphone and speakers. The display may be any suitable electronic display such as, for example, a Liquid Crystal Display (LCD) or a touchscreen display (e.g., resistive, capacitive, etc.). The camera included on the resident communications terminal 125*a* may be any suitable imaging device such as, for instance, a video camera or webcam equipped with Charge-Coupled Devices (CCDs), Complementary Metal-Oxide-Semiconductor (CMOS) active pixel sensors, etc. A handset may be similar to a traditional telephone handset including an earpiece portion (with a speaker), a handle portion, and a mouthpiece portion (with a microphone). In certain embodiments, the resident communications terminal 125*a* may allow a resident to utilize a headset with earphones and a microphone in place of a traditional handset.

In certain embodiments, the controlled environment facility visitation system 100 may provide residents of the controlled-environment facility with visitation services using a portable communications device 125*b*. In certain embodiments, a portable communications device 125*b* may be a personal wireless devices, such as a tablet computing device or a smartphone device, that has been assigned to a resident. Similar to the resident communications terminal 125*a*, the portable communications device 125*b* may likewise include a camera, display, microphone and speakers and may be used both for voice visitation sessions and video visitation sessions. In certain scenarios, a portable communications device 125*b* may be referred to as an Intelligent Resident Device (IRD), or in a correctional institution environment, as an Intelligent Inmate Device (IID).

In many scenarios, the portable communications device 125*b* may be especially adapted for use in a controlled-environment facility. For instance, in a correctional facility, the portability of a portable communications device 125*b* may be limited by mounting or attaching the device on a wall, within a booth or as part of kiosk. In certain scenarios, the portable communications device 125*b* may be protected within a hardened case that prevents any modifications to the hardware of the device. Various features of the hardware and/or software of the portable communications device 125*b* may be modified in order to prevent unauthorized use of the device. For instance, in a correctional institution, a portable communications device 125*b* may operate using a specially adapted operating system or operating system kernel. A portable communications device 125*b* may also be restricted with respect to the allowed software applications that may be used by a resident. The portable communications device 125*b* may also be configured to prevent the resident from installing or modifying any applications on the device, thus limiting the resident to the use of software programs authorized for use by the controlled-environment facility. The portable communication device 125*b* may be assigned for use by a resident on a temporary or permanent basis.

In various scenarios, a portable communications device 125*b* and/or a resident communications terminal 125*a* may provide a resident of the controlled-environment facility with access to various software applications and services in addition to providing voice and video visitation sessions. For example, residents may be provided with legal research service, education services, employment search services, supervised email access, supervised online chat session, applications for playback of approved music and video files and/or supervised messaging. In certain scenarios, a portable communications device 125*b* and/or a resident communications terminal 125*a* may provide a resident with access to commissary services provided by the controlled-environment facility. In certain scenarios, portable communications device 125*b* and/or a resident communications terminal 125*a* may include a web browser which may be limited to only accessing secure websites and/or third party websites of approved vendors. Portable communications device 125*b* and/or a resident communications terminal 125*a* may also provide residents with access to various services specific to the controlled-environment facility, such as scheduling a visitation session and requesting medical appointments.

A portable communications device 125*b* may also be restricted with respect to the network connectivity that is afforded to a resident of the controlled-environment facility. In many scenarios, a portable communications device 125*b* may be configured to connect only to a specific network hosted by one or more internal wireless access points 120 provided by the controlled environment facility visitation system 100. A portable communications device 125*b* may be further restricted to connect only to a specific wireless network available within certain areas of a controlled-environment facility, such as a dedicated visitation area or other supervised area. In certain scenarios, network connectivity for a portable communications device 125*b* may be limited by placing wireless access points and positioning directional antenna within the physical structure of the controlled-environment facility such that the generated wireless signals are restricted to limited areas within the facility.

In many scenarios, use of a resident communications terminal 125*a* and a portable communications device 125*b* is limited based on security protocols implemented by the controlled environment facility visitation system 100. For instance, a resident may be required to enter a PIN (Personal Identification Number) before being allowed to use a resident communications terminal 125*a* or a portable communications device 125*b*. A resident may similarly be required to provide biometric verification, such as using a voice print, fingerprint, facial image or other biometric indicator in order to use a resident communications terminal 125*a* or a portable communications device 125*b*. Access to specific applications and services provided by a resident communications terminal 125*a* and a portable communications device 125*b* may also be limited to residents based on additional security protocols, such as requiring a password, prior to allowing a resident to access specific services.

In the illustrated embodiment, the controlled environment facility visitation system 100 utilizes an administration and management system 145 in enforcing security protocols that are applicable to the use of communication services provided to residents of the controlled-environment facility. For instance, in providing the described visitation services, the visitation server 105 may limit a resident's visitation sessions to sessions with nonresidents whose identities are listed in that resident's Pre-Approved Contact (PAC) and/or Personal-Allowed Number (PAN) list. In some scenarios, the information in the administration and management system 145 may be used by the visitation server 130 to enforce restrictions prohibiting a resident from communicating with certain individuals identified in a "do not contact" list. In various scenarios, the identity of a non-inmate used by the visitation server 105 in enforcing such restrictions may be identified based on the phone number of the nonresident, the device presented for use by a nonresident and/or the email addresses or other accounts used by the nonresident. Each resident's PAC, PAN, and/or do not contact list(s) may be stored, for example, in database maintained by the administration and management system 145. In certain scenarios, the administration and management system 145 may also be used to store biometric information used to authenticate individual users of the controlled environment facility visitation system 100. In addition to PAC, PAN, and/or do not contact list(s), administration and management system 145 may also store other security profiles and rules that are applicable to each resident.

The administration and management system 145 may also be used to manage information such as balances in a resident's trust, commissary and/or calling accounts. The administration and management system 145 may also provide access to other information pertaining to a resident, including for instance a resident's trial schedule, conviction data, criminal record, sentencing data (such as time served, time remaining to be served, and projected release date), cell and cellmate assignments, resident-specific restrictions and warnings, commissary order history, telephone call history, call recordings, known or suspected gang or criminal affiliations, known or suspected affiliates, accomplices, or gang members; and any other information that may be relevant or useful to correctional facility staff to house and maintain residents. In various embodiments, the administration and management system 145 may be comprised of one or more separate systems.

As described, the controlled environment facility visitation system 100 may be configured to perform various monitoring operations related to visitation sessions. For instance, the controlled environment facility visitation system 100 may be configured to allow staff to monitor live visitation sessions and to interrupt or terminate an ongoing visitation session. In addition, the controlled environment facility visitation system 100 may record visitation sessions, such as by generating audio and/or video files of the visitation session. These recorded visitation sessions may be stored to a database maintained by the administration and management system 145. In certain embodiments, the controlled environment facility visitation system 100 may provide access to various tools that can be used to search the recorded visitation sessions in support of investigative activities.

In the embodiment of FIG. 1, the authentication service 130, visitation schedule service 135 and visitation monitoring 140 are components of the visitation server 105. In certain embodiments, one or more of these described functions of the visitation server 105 may instead be provided by systems external to the visitation server 105 or external to the controlled environment facility visitation system 100. In certain of such embodiments, one or more of the functions of the visitation server may be provided on behalf of multiple controlled-environment facilities by centralized systems.

FIG. 2 is a flowchart diagram providing certain steps of a process according to various embodiments for providing a resident of a controlled environment facility with the ability to participate in a visitation session with a nonresident that is using a personal wireless device, while still allowing the controlled-environment facility to monitor all aspects of the visitation session. In the illustrated embodiment, the process begins at step 205 with the identity of the nonresident being verified by the controlled environment facility that is hosting the nonresident in the requested visitation session with the resident. In certain scenarios, the identity of the nonresident may be manually verified by a staff member of the controlled environment facility, such as via manual verification of identity using an official form of photo identification. In certain scenarios, the identity of the nonresident may be verified using biometrics. For instance, the identity of the nonresident may be verified by the controlled environment facility using a fingerprint, voice, and/or facial recognition scanner. In certain embodiments, the identity information determined using biometric scanners or confirmed manually may be provided to the controlled environment facility visitation system 100 for use in processing the visitation session request.

Once the identity of the nonresident is confirmed at step 205, the nonresident is allowed to enter into a designated visitation area of the controlled environment facility from which the external visitation network may be accessed by the nonresident. As described, the visitation area may include booths, kiosks or other privacy partitions to which a nonresident may be assigned. At step 210, the nonresident utilizes their personal wireless device to connect to the external wireless visitation network hosted by the controlled environment facility. In certain scenarios, the nonresident may be provided with instructions for directing their personal wireless to a non-public wireless visitation network that is hosted by a wireless visitation access point. In certain embodiments, the wireless access point broadcasts a public SSID corresponding to the described visitation service that permits the nonresident to participate in the visitation session via their personal wireless device. In certain scenarios, the nonresident may initiate a connection with the SSID of the wireless visitation network using their personal wireless devices in the same manner as when connecting to a public wireless access point.

At step 215, the visitation system determines whether the personal wireless device utilized by the nonresident is recognized and has been registered for use of the described visitation services. As described in additional detail with regard to the embodiment of FIG. 3, use of a personal wireless device in a visitation session may first require registration of the nonresident and the personal wireless device, and may additionally require the installation of necessary visitation system software on the personal wireless device. In certain embodiments, the visitation system software installed on the personal wireless device may include various safeguards that prevent misuse of the described visitation system. For instance, in certain embodiments, visitation system software that is installed as part of the registration of the personal wireless device may be configured to be operable by a user of the personal wireless device only while the personal wireless device is connected to a specific visitation server and/or to external wireless access point(s) provided by a visitation system.

In certain embodiments, the visitation system may interrogate the personal wireless device from which a connection request is received in order to more precisely identify the nonresident personal wireless device. For instance, the nonresident may be asked to authorize the personal wireless device to provide the visitation system with information such as the phone number associated with the personal wireless device or with a unique identifier associated with personal wireless device, such as a MAC address. In certain scenarios, the nonresident may be prompted to provide their name, as used to register for the visitation service. In certain embodiments, the visitation system may detect a request originating from visitation system software installed on a nonresident personal wireless device. In such embodiments, the visitation system may interface with the installed visitation system software to confirm the registration of the personal wireless device.

If a connection request is determined to originate from an unidentified personal wireless device and/or a non-registered nonresident, at step 240, the nonresident may be redirected to the instructions and subsystems for registering for use of the described visitation service and for registering a personal wireless device. If the nonresident and the personal wireless device are authorized to proceed, at step 220 the visitation session request of the nonresident may be evaluated.

The nonresident may be further interrogated, via their personal wireless device, by the visitation system in order to determine the details of the visitation session that is being requested, including the identity of the resident with which a visitation session is being requested. In certain embodiments, the visitation system may utilize information obtained at step 205 in order to identify a scheduled visitation session request that corresponds to the date and time of the nonresident's arrival at the designated visitation area. In scenarios where a corresponding scheduled visitation request is identified, at step 220, the visitation system may require the nonresident, via their personal wireless device, to confirm certain details of the identified scheduled visitation request. If the requested visitation session does not correspond to any scheduled visitation request, at step 225, the visitation system may forward the visitation request for manual authorization.

If the requested visitation session is determined to be authorized, at step 230 the status of the resident is determined. In certain embodiments, the visitation system may connect the nonresident directly to an initiated visitation session in which the resident has already joined. In scenarios where the resident has not already joined, once the visitation session has been authorized, the visitation session may be initiated and the nonresident placed on hold until the resident has joined the visitation session. The visitation system may be configured to match incoming visitation requests, at step 235, to already initiated visitation sessions in order to connect residents and nonresidents in requested visitation sessions.

As described, certain visitation sessions may be conducted with resident and nonresident separated by a glass barrier and using communication devices for establishing an audio link between the resident and the nonresident. As described, a resident may participate using a communications terminal or a portable communication device. The nonresident may participate in such line-of-sight visitations using a personal wireless device that has been authorized by the visitation server to establish an audio link with the communication device used by the resident. In such scenarios, the nonresident participates from a visitation area that is in the same controlled-environment facility that houses the resident. In scenarios where the resident and nonresident are utilizing devices that support video visitation sessions, the visitation session may be conducted between a resident in one controlled environment facility and a nonresident participating from a designated visitation area of another controlled environment facility. In this manner, a nonresident may participate in a supervised visitation session from a designated visitation area of any controlled-environment facility that uses a visitation system in common with the controlled-environment facility that houses a resident.

FIG. 3 illustrates certain steps of a process according to various embodiments for registering a personal wireless device of the nonresident for use in visitation services. As described, upon being authorized for entry into a designated visitation area, a nonresident may utilize a personal wireless device to connect to a visitation network. Upon receiving a connection request from a nonresident personal wireless device, at step 300, the visitation system determines identifying information for the nonresident and the personal wireless device. In scenarios where a connection request is received from a registered personal wireless device, the connection request may be issued by visitation system software installed as part of the registration of the personal wireless device. In such embodiments, the visitation software installed on the personal wireless device may be configured to issue a connection request that is recognized by a wireless access point as originating from an individual purporting to be an authorized nonresident user of the visitation system. In such scenarios, the wireless access point may be configured to forward the connection request to the visitation server for authentication of the nonresident and the personal wireless device.

As described, the visitation system software installed on the personal wireless device may be configured to include various safeguards. The visitation server may interoperate with the installed visitation software in the implementation of certain of such safeguards during the authentication of the personal wireless device. For instance, in certain embodiments, the installed visitation system software may be operable only while connected to the visitation system. In such embodiments, the visitation server may utilize information provided by the installed visitation software to determine visitation server(s) and/or external wireless access point(s) that the personal wireless device is authorized to access. In this manner, a specific nonresident personal wireless device may be authorized to use the visitation system, but only from a specific controlled-environment facility or only from a specific visitation area at a specific controlled-environment facility. In such embodiments, the nonresident may be blocked by the installed visitation software from any actions other than issuing a connection request until a connection can be established to the visitation system from an authorized location.

In certain embodiments, the visitation system may direct incoming connection requests to a user interface by which the nonresident is asked to provide and/or confirm identifying information, such as the name of the nonresident, the telephone number of the nonresident, identifying information about the personal wireless device, and/or email address. As described, in certain visitation scenarios, the identity of the nonresident may be manually verified by a staff member or automatically verified using biometrics in order for the nonresident to gain entry into the visitation area. In such scenarios, the verified identity of the nonresident being admitted to the visitation area may be provided to the visitation system, such that the visitation system may be configured to only accept incoming connection requests from nonresidents that have been identified and authorized to enter the visitation area.

At step 305, the visitation system utilizes the identifying information to determine whether the nonresident and the personal wireless device have been authorized to utilize the provided visitation service. In certain scenarios, the visitation system may utilize the identifying information to verify that the specific personal wireless device being utilized has been previously determined to be associated with the identity of the nonresident. For instance, the phone number of a personal wireless device, such as a smart phone, that has issued a connection request may be confirmed by the visitation system as a phone number previously established as corresponding to the nonresident. In other scenarios, such as the nonresident utilizing a tablet device, a unique identifier for the tablet device may be used to determine if the incoming connection request originates from a recognized personal wireless device. In embodiments utilizing visitation system software installed on the personal wireless device, the visitation system may determine whether a personal wireless device is registered strictly by interfacing with the installed visitation software and without any additional inputs from the nonresident.

In certain embodiments, the identity of the nonresident may be used, at step 305, by the visitation system to determine whether the nonresident is authorized to use the visitation service. In certain scenarios, a connection request may be denied by the visitation system upon determining that the nonresident has been identified in a listing of individuals that have been specifically barred from using the visitation service.

In scenarios where the visitation service determines that the incoming connection request originates from a registered personal wireless device and/or from a registered nonresident, at step 330 and as described in additional detail in FIG. 4, the visitation system may proceed to evaluate the visitation session request that is being presented by the nonresident. If instead either the personal wireless device or the nonresident are determined as being unregistered, at step 310, the visitation system may initiate procedures for enrolling a nonresident and/or a personal wireless device for use of the visitation services.

Registration may commence at step 315, with the visitation system determining whether the nonresident is allowed to enroll in the visitation service. For instance, nonresidents below a certain age may be prohibited from enrolling. The visitation system may also prohibit certain individuals from enrolling in the visitation system, such as identified gang members, conspirators, former residents and/or a specific individual that have been prohibited from using the visitation system. At step 315, the visitation system may utilize additional forms of verification of the identity of the nonresident. For instance, the visitation system may require a nonresident enrollee to provide voice, fingerprint and or facial image samples. The provided biometric information may be used to determine if the nonresident is prohibited for any reason from enrolling and for verification of the identity of the nonresident in the processing of a future visitation request.

If the nonresident is determined to be allowed to enroll in the visitation service, at step 320, the visitation service determines the visitation services that may be provided based on the capabilities of the personal wireless device being utilized by the nonresident. In certain embodiments, the nonresident may be prompted to authorize the personal wireless device in providing the visitation system with information describing the hardware and software of the personal wireless device, such as the manufacturer and model number of the personal wireless device, the operating system and version information for the personal wireless device, and available audio and video capabilities. Based on the specific personal wireless device, the visitation system may determine the available visitation services that are supported by the personal wireless device. For instance, where video is not supported by a personal wireless device, only audio visitation sessions may be available to a nonresident.

At step 325, the personal wireless device is registered in the visitation system such that upon subsequent visitation requests, a connection request from the personal wireless device will be recognized as originating from a registered device. In certain embodiments, the visitation system may prompt the nonresident to authorize the installation of necessary software on the personal wireless device. Such software may include programs for interfacing with the visitation system in negotiating connection requests on behalf of the personal wireless device and programs for allowing the nonresident to participate in various types of visitation sessions that are supported, such as video conferencing software or specific codecs for use in video visitation sessions. In certain embodiments, the nonresident may be directed to a service by which visitation software may be downloaded and installed on the personal wireless device.

FIG. 4 illustrates certain steps of a process according to various embodiments for authorizing a visitation session between a resident and a nonresident using a personal wireless device. As described, information describing the personal wireless device and/or the identity of the nonresident may be used in order to determine whether the personal wireless device and the nonresident are registered for use of the visitation service. If the nonresident and/or the personal wireless device are determined to be recognized and properly registered, at step 405, the visitation service may prompt the nonresident to enter additional information for the requested visitation session. For instance, if the identity of the nonresident has not already been used to match the nonresident to a corresponding scheduled visitation with a specific resident, the nonresident may be asked to identify the resident and to provide information identifying a scheduled visitation request.

At step 410, the visitation system may implement various checks for confirming that the nonresident is allowed to communicate with the resident specified in the visitation request. For instance, a nonresident may be prohibited from visiting a specific resident due to previous unauthorized use of the visitation system, or due to restrictions prohibiting the resident from communicating with specific individuals, such as known criminal affiliates.

In certain embodiments, the visitation server may determine whether a fee is required to proceed with the requested visitation between the resident and the nonresident using their personal wireless device. Certain visitation sessions, such as sessions involving counseling or legal services, may be provided without a fee. In scenarios where a fee is required, the visitation server may determine whether an account maintained on behalf of a resident has sufficient funds to pay the fee. In certain scenarios, the nonresident may be presented with the option of paying the required fee once the requested visitation session has been determined to be authorized. In certain scenarios, a fee may be charged for each individual visitation session. In other scenarios, a fee may provide a specified amount of visitation session time over a specified time period, such as a subscription allowing a resident twenty hours of visitation per month. In certain scenarios, a nonresident may agree to be billed for an individual visitation session or for a subscription providing a resident with a specified amount of visitation time.

If the requested visitation session is allowed to proceed, at step 415, the visitation system determines whether the requested visitation session is ready to begin. As described, upon the resident or nonresident being authorized to participate in a requested visitation session, the visitation session may be initiated by the visitation server and the first arriving participant may be placed on hold while the visitation system waits to detect a connection request from the other expected participant in the schedule visitation session.

With the requested visitation session ready to begin, at step 420, in certain embodiments, the visitation system may send an access code to the personal wireless device registered to the nonresident. In certain embodiments, the access code may be sent as a text message to the phone number that has been registered for the nonresident. In other embodiments, an access code may be sent to an email address that has been registered for the nonresident. In such scenarios, the access code provides additional verification that the nonresident participant has been properly registered and is using a personal wireless device that has been properly registered.

At step 425, the nonresident uses their personal wireless device to confirm the received access code. For instance, the visitation system may interface with the personal wireless device to prompt the nonresident to enter the provided access code. Accordingly, in scenarios where a verified nonresident is using a registered personal wireless device, the visitation system may evaluate a visitation request such that the nonresident may access the provided visitation services without having to provide any verifications beyond confirming the access code sent to the personal wireless device.

Upon confirmation of the access code by the nonresident, at step 430 the requested visitation session with the resident may be authorized and initiated. In certain embodiments, the resident may likewise be required to confirm an access code via the communications device being used by the resident. In certain embodiments, the access code generated by the visitation system may be configured to expire at the designated end time for the requested visitation session. In such embodiments, the expiration of the access code may cause the visitation session to be terminated at the time visitation session is scheduled to end. In certain embodiments, visitation system software installed on the personal wireless device may be configured to monitor for the expiration of the access code associated with a visitation session. The visitation system software installed on the personal wireless device may be further configured to terminate the visitation session upon detecting the expiration of an access code.

Once a visitation session has been authorized, the personal wireless device may be allowed to participate in the requested visitation session using the capabilities of the personal wireless device. For instance, the nonresident may utilize audio-conferencing software and/or audio conferencing software to establish an authenticated session with a video conference hosted via the visitation server. In certain embodiments, the visitation session may be conducted via visitation system software installed on the personal wireless device. For instance, the installed visitation system software may include an audio and/or videoconferencing client that is configured to interoperate with the visitation server.

In certain embodiments, the visitation system software installed on the personal wireless device may also allow the nonresident to utilize additional services supported by the controlled-environment facility. For instance, the visitation system may be one of several services that are accessible by a registered personal wireless device via a portal that is made available by the controlled-environment facility. In a correctional setting, a portal may provide access to educational services, employment search resources, commissary accounts, visitation scheduling, legal research services, supervised email services, and/or supervised chat services. The installed visitation system software may be configured to allow the nonresident to access certain of the services that are offered by a portal. For instance, once a personal wireless device has been identified as a registered device, the installed visitation system software may allow the nonresident to access certain commissary account functions available via the portal, such as the ability to contribute funds to a resident's commissary account, or an account from which visitation session fees may be paid. In another scenario, the visitation system software may allow the nonresident to access portal functions that allow the nonresident view and schedule visitation session requests.

In certain embodiments, access to portal services may be provided to nonresidents during an ongoing visitation session. Other embodiments may additionally or alternatively allow access to portal services prior to or after the completion of a visitation session. Certain embodiments may provide access to the portal via visitation software installed on the personal wireless device. Other embodiments may allow a registered personal wireless device to access portal services via other applications installed on the personal wireless device, such as a web browser.

As described, certain embodiments may limit a nonresident's use of the visitation system to specific visitation areas of a controlled-environment facility, such as in a correctional setting where all aspects of the visitation session are monitored. In other scenarios, registered personal access devices may be utilized throughout a controlled-environment facility. For instance, in an educational setting, a school may allow parents using registered personal wireless devices to connect to a wireless network provided by the school. In certain embodiments, software for accessing the school's wireless network may be installed as part of the registration of a personal wireless device. In such embodiments, the installed software may enable a personal wireless device to access certain functions of a portal provided by the school while the personal wireless devices is connected to the school's wireless network. In such educational settings, certain of the portal functions may be enabled for a connected personal wireless device such as accessing and funding dining accounts, accessing student and school schedules, and accessing directory information. In this manner, a visitor to a school may use a registered personal wireless device to connect to the school's wireless network such that authorized portal functions are available to the visitor while the visitor is at the school and connected to the school's network.

FIG. 5 is a block diagram of a communication processing system 500 configured according to certain embodiments to support the described visitation server. Visitation server 500 may include one or more processors 501. In various embodiments, visitation server 500 may be a single-processor system including one processor 501, or a multi-processor system including two or more processors 501. Processor(s) 501 may include any processor capable of executing program instructions, such as an Intel Pentium™ series processor or any general-purpose or embedded processors implementing any of a variety of Instruction Set Architectures (ISAs), such as the x86, POWERPC®, ARM®, SPARC®, or MIPS® ISAs, or any other suitable ISA.

Visitation server 500 may include a chipset 502 that may include one or more integrated circuits that are connected to processor(s) 501. In certain embodiments, the chipset 502 may utilize a QPI (QuickPath Interconnect) bus 503 for communicating with the processor(s) 501. Chipset 502 provides the processor(s) 501 with access to a variety of resources. For instance, chipset 502 provides access to system memory 505 over memory bus 504. System memory 505 may be configured to store program instructions and/or data accessible by processors(s) 501. In various embodiments, system memory 505 may be implemented using any suitable memory technology, such as static RAM (SRAM), synchronous dynamic RAM (SDRAM), nonvolatile/Flash-type memory, or any other type of memory.

Chipset 502 may also provide access to a graphics processor 507. In certain embodiments, graphics processor 507 may be comprised within one or more video or graphics cards that have been installed as components of the visitation server 500. Graphics processor 507 may be coupled to the chipset 502 via a graphics bus 506 such as provided by an AGP (Accelerated Graphics Port) bus, a PCIe (Peripheral Component Interconnect Express) bus. In certain embodiments, graphics processor 507 generates display signals and provides them to a display device 108 that may be coupled directly to the visitation server 500 or may be located remotely from the visitation server 500.

In certain embodiments, chipset 502 may also provide access to one or more user input devices 511. In such embodiments, chipset 502 may be coupled to a super I/O controller 510 that provides interfaces for a variety of user input devices 511, in particular lower bandwidth and low data rate devices. For instance, super I/O controller 510 may provide access to a keyboard and mouse or other peripheral input devices. In certain embodiments, super I/O controller 510 may be used to interface with coupled user input devices 511 such as keypads, biometric scanning devices, and voice or optical recognition devices. The user input devices 511 may interface with super I/O controller 510 through wired or wireless connections. In certain embodiments, the super I/O controller 510 may be coupled to the super I/O controller 510 via a Low Pin Count (LPC) bus 513.

Other resources may also be coupled to the processor(s) 501 of the visitation server 500 through the chipset 502. In certain embodiments, chipset 502 may be coupled to a network interface 509, such as provided by a Network Interface Controller (NIC) that is coupled to the visitation server 500. In certain embodiments, the network interface 509 may be coupled to the chipset 502 via a PCIe bus. According to various embodiments, network interface 509 may support communication via various wired and/or wireless networks. Chipset 502 may also provide access to one or more hard disk and/or solid state drives 515. In certain embodiments, the chipset 502 may also provide access to one or more optical drives 514 or other removable-media drives. Any or all of the drive devices 514 and 515 may be integral to the visitation server 500, or may be located remotely from the visitation server 500. In certain embodiments, the chipset 502 may also provide access to one or more Universal Serial Bus (USB) ports 516.

In various embodiments, a visitation server 500 does not include each of the components shown in FIG. 5. In various embodiments, a visitation server 500 may include various additional components in addition to those that are shown in FIG. 5. Furthermore, some components that are represented as separate components in FIG. 5 may in certain embodiments instead be integrated with other components. For example, in certain embodiments, all or a portion of the functionality provided by the illustrated components may instead be provided by components integrated into the one or more processor(s) 501 as a systems-on-a-chip.

The foregoing has outlined rather broadly the features and technical advantages of the present invention in order that the detailed description of the invention that follows may be better understood. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A visitation system for providing visitation services to a resident of a controlled-environment facility, the system comprising:

an external wireless local area network access point configured to receive a connection request from a personal wireless device of a nonresident, wherein the external wireless local area network access point is accessible from a designated visitation area of the controlled-environment facility;

an authorization server configured to evaluate the connection request, wherein the evaluation determines whether the personal wireless device of the nonresident is authorized to interface with the visitation system, and wherein the evaluation determines whether the nonresident is authorized to communicate with the resident; and a visitation server configured to establish a visitation session between the resident and the nonresident, wherein the nonresident participates via the personal wireless device, via the external wireless local area network access point.

2. The system of claim 1, wherein the nonresident participates in the visitation session via a visitation system software program installed on the personal wireless device.

3. The system of claim 2, wherein visitation system software program is operable by the nonresident only while the personal wireless device is connected to the external local area network wireless access point.

4. The system of claim 1, wherein the identity of the nonresident is confirmed in order for the nonresident to be admitted to the designated visitation area, and wherein the confirmed identity of the nonresident is provided to the visitation system.

5. The system of claim 4, wherein the visitation server is configured to identify a scheduled visitation session based on the admittance of the nonresident to the designated visitation area.

6. The system of claim 1, wherein determining whether the personal wireless device of the nonresident is authorized to interface with the visitation system comprises determining whether a unique identifier associated with the personal wireless device indicates the personal wireless device has been previously registered by the visitation system.

7. The system of claim 6, wherein the authentication server sends an access code to a phone number previously registered as being associated with the personal wireless device.

8. The system of claim 7, wherein the authentication server authorizes the visitation session upon receiving the access code from the nonresident via a user interface on the personal wireless device.

9. The system of claim 8, wherein the visitation session is terminated upon expiration of the access code.

10. A method for providing visitation services to a resident of a controlled-environment facility, the method comprising:

receiving, at an external wireless local area network access point, a connection request from a personal wireless device of a nonresident, wherein the external wireless local area network access point is accessible from a designated visitation area of the controlled-environment facility;

evaluating, by an authorization server, the connection request, wherein the evaluation determines whether the personal wireless device of the nonresident is authorized to access the visitation services, and wherein the evaluation determines whether the nonresident is authorized to communicate with the resident; and establishing, by a visitation server, a visitation session between the resident and the nonresident, wherein the nonresident participates via the personal wireless device, via the external wireless local area network access point.

11. The method of claim 10, wherein the connection request comprises a request for the visitation session between the nonresident and the resident.

12. The method of claim 11, wherein the identity of the nonresident is confirmed in order for the nonresident to be admitted to the designated visitation area.

13. The method of claim 12, wherein the confirmed identity of the nonresident is provided to the visitation system.

14. The method of claim 13, further comprising:

identifying, by the visitation server, a scheduled visitation session based on the admittance of the nonresident to the designated visitation area.

15. The method of claim 10, wherein determining whether the personal wireless device of the nonresident is authorized to access the visitation services comprises determining whether a unique identifier associated with the personal wireless device indicates the personal wireless device has been previously registered.

16. The method of claim 15, further comprising:

sending a text message including an access code to a phone number previously registered as being associated with the personal wireless device.

17. The method of claim 16, further comprising:

authorizing, by the authentication server, the visitation session upon receiving the access code from the nonresident via a user interface on the personal wireless device.

18. The method of claim 17, further comprising:

terminating the visitation session upon expiration of the access code.

19. A computer-readable storage device having program instructions stored thereon for providing visitation services to a resident of a controlled-environment facility, upon execution by a one or more processors, the program instructions cause the one or more processors to:

receive a connection request from a personal wireless device of a nonresident, via an external wireless local area network access point, wherein the external local area network wireless access point is accessible from a designated visitation area of the controlled-environment facility;

evaluate the connection request, wherein the evaluation determines whether the personal wireless device of the nonresident is authorized to access the visitation services, and wherein the evaluation determines whether the nonresident is authorized to communicate with the resident; and establish a visitation session between the resident and the nonresident, wherein the nonresident participates via the personal wireless device, via the external wireless local area network access point.

20. The computer-readable storage device of claim 19, wherein the connection request comprises a request for the visitation session between the nonresident and the resident.

* * * * *